US005830313A

United States Patent [19]

Smith

[11] Patent Number: 5,830,313

[45] Date of Patent: Nov. 3, 1998

[54] SELF-PROPELLED FLOOR COVERING SCRAPER MACHINE

[75] Inventor: Mark C. Smith, Rockville, Md.

[73] Assignee: MARCOR Management, Inc., Hunt Valley, Md.

[21] Appl. No.: 355,284

[22] Filed: Dec. 12, 1994

[51] Int. Cl.[6] ..... B32B 35/00

[52] U.S. Cl. ..... 156/584; 30/170; 299/37.1; 74/488; 74/496; 180/6.6; 180/315

[58] Field of Search ..... 180/6.48, 6.5, 180/6.58, 6.6, 315; 74/484 R, 486, 488, 496; 156/584; 30/170; 299/37.1

[56] References Cited

U.S. PATENT DOCUMENTS

| | | | |
|---|---|---|---|
| 2,245,544 | 6/1941 | Miller | 262/8 |
| 2,834,605 | 5/1958 | McCollough | 74/496 X |
| 2,864,104 | 12/1958 | Sage . | |
| 3,542,433 | 11/1970 | Probst | 299/37 |
| 4,053,183 | 10/1977 | Probst | 299/36 |
| 4,133,392 | 1/1979 | Freese | 172/809 |
| 4,277,104 | 7/1981 | Sanchez | 299/37 |
| 4,335,626 | 6/1982 | Fisher | 74/496 |
| 4,428,090 | 1/1984 | Coggin et al. | 15/93 |
| 4,668,017 | 5/1987 | Peterson et al. | 299/37 |
| 5,002,629 | 3/1991 | Nakamura | 156/584 |
| 5,181,579 | 1/1993 | Gilliem | 180/6.48 |
| 5,197,784 | 3/1993 | Holder | 30/170 X |

FOREIGN PATENT DOCUMENTS

| | | | |
|---|---|---|---|
| 2842234 | 4/1979 | Germany | 74/496 |
| 3-36370 | 2/1991 | Japan | 156/344 |

OTHER PUBLICATIONS

Operator's Manual, "Toro Proline 190 Mid Size Mower—Hydro" (The Toro Company, 1991).

Cooper Incorporated, "Tile & Mastic Removal" (undated advertising material).

*Primary Examiner*—Mark A. Osele

*Attorney, Agent, or Firm*—Roylance, Abrams, Berdo & Goodman, LLP

[57] ABSTRACT

A self-propelled floor covering scraper machine including a frame having front and back ends, two independently controllable wheels, mounted on each side toward the back end of the frame, mechanisms for independently driving each wheel in either a forward or reverse direction, a control mechanism for steering the machine, engaging the driving mechanisms, and controlling the forward and reverse movement of each wheel, and a scraper blade mounted to the front end of the frame at an angle extending downward and forward. The adjustable scraper blade assembly includes a blade bracket, a generally flat scraper blade attachable to the blade bracket, and a shock absorber for the blade during use. The mechanism for controlling the steering and the forward and reverse movement of the vehicle uses a horizontal crossbar rotatably connected at each end to a support on the vehicle. The crossbar's axis of rotation is perpendicular to the forward motion of the vehicle. A generally T-shaped yoke having a cross portion is attached at its center to a straight portion. The other end of the straight portion is rotatably attached to the crossbar. The axis of rotation of the straight portion is perpendicular to the crossbar's axis of rotation. The mechanism uses two linkages connected to each end of the cross portion. The linkages are respectively connected at the other of their ends to the means for controlling the forward and reverse direction of the mechanisms for driving the right and left sides of the vehicle.

12 Claims, 6 Drawing Sheets

FIG. 3A
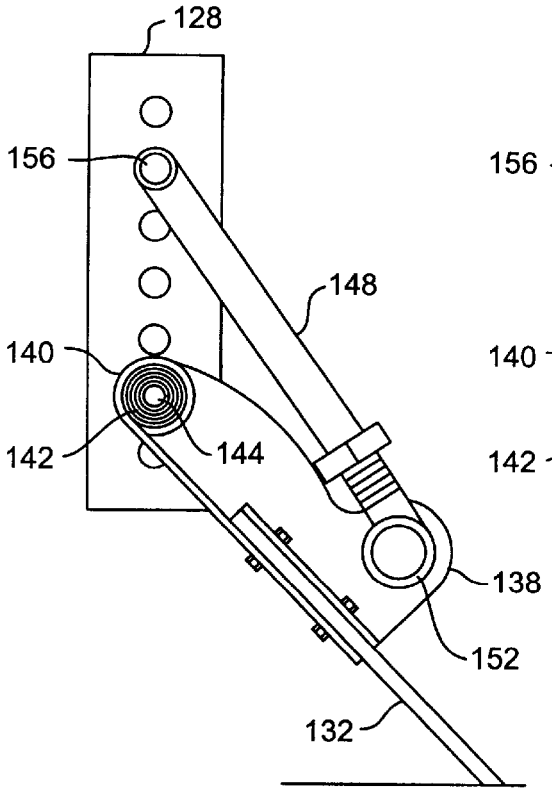
FIG. 3B
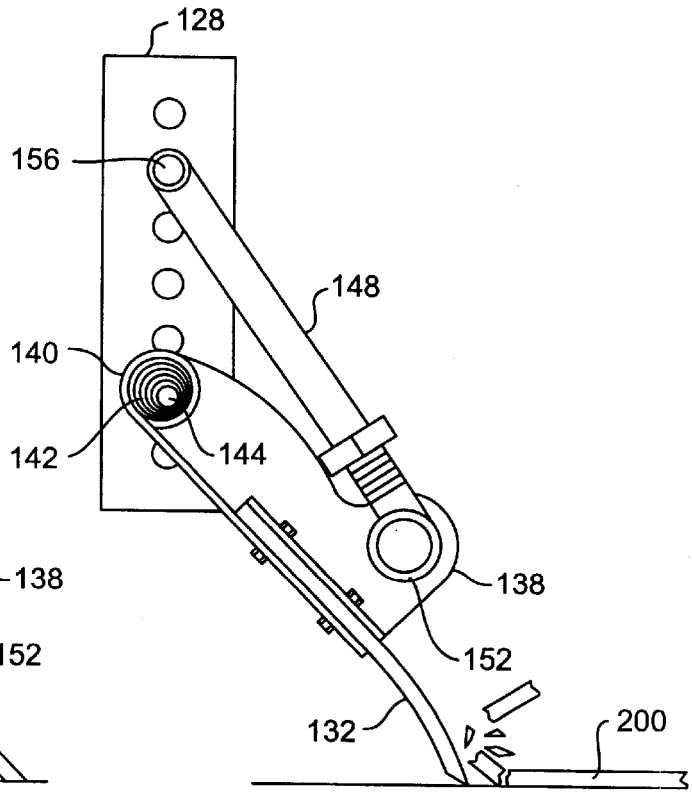
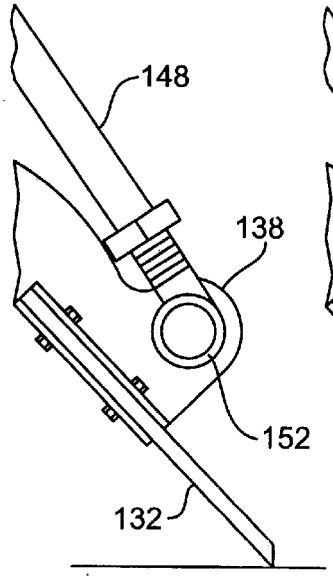
FIG. 4A
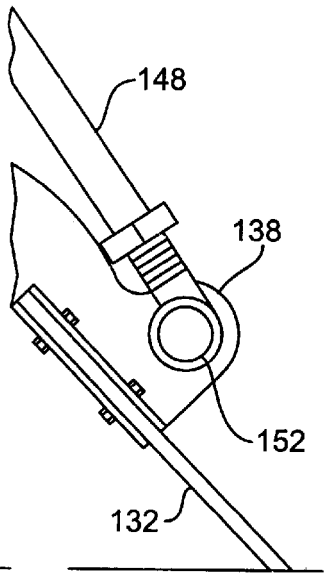
FIG. 4B

SELF-PROPELLED FLOOR COVERING SCRAPER MACHINE

BACKGROUND OF THE INVENTION

1. Field of the Invention

This invention relates generally to a self-propelled machine for removing tiles and other floor covering from the surfaces of floors. The invention also relates to an adjustable scraper blade assembly suitable for mounting on a machine used to remove floor covering. The invention further relates to a single control mechanism for operating the steering, and the forward and reverse movement of a self-propelled machine.

2. Description of the Prior Art

A number of machines have been developed for removing roofing or floor covering materials. Such machines are disclosed, for example, in U.S. Pat. Nos. 2,245,544, 2,864,104, 3,542,433, 4,053,183, 4,277,104, 4,668,017 and 5,002,629. In another similar prior art machine, a large hydraulic pump in a stationary location outside the work area was connected by long hoses to a bulky hydrostatic transmission on the vehicle. The large hydraulic pump was powered by a large horsepower motor which was believed to be necessary to provide enough torque to peel up the tile. It was not feasible to mount such a large hydraulic pump and large motor on the vehicle itself The hydraulic connecting hoses and stationary motor and hydraulic pump significantly limited the accessibility and maneuverability of the vehicle. Moreover, the vehicle together with its pump and motor were not easily portable to and from the job site.

None of the prior art machines combine the speed, maneuverability, ease of control, accessibility or portability required to remove tiles and other floor coverings as effectively inside small rooms of buildings as in large open areas.

SUMMARY OF THE INVENTION

In accordance with the present invention, a self-propelled floor covering scraper machine is disclosed which is suitable for removing tile and other floor coverings from floor surfaces. The machine comprises a frame having a front end and a back end, two independently controllable wheels, one of which is mounted toward the back end of the right side of the frame and the other of which is mounted toward the back end of the left side of the frame opposite the first wheel, means for independently driving each wheel in either a forward or reverse direction, a control mechanism for steering the machine, engaging the driving means, and controlling the forward and reverse movement of each wheel, and a scraper blade mounted to the front end of the frame at an angle extending downward and forward from the front end of the frame. Preferably, an hydraulic motor is connected to each wheel for independently driving each wheel. The angle of the scraper blade is preferably adjustable.

The present invention also includes an adjustable scraper blade assembly which is suitable for mounting on a machine used to remove floor covering. The assembly comprises a blade bracket attachable to the front of the machine, a generally flat scraper blade attachable to the blade bracket, and a means for absorbing shock to the blade during use. In a preferred embodiment, the assembly comprises a blade mount comprising two vertical flanges disposed perpendicular to the front of the machine, wherein each flange has a plurality of vertically aligned holes therethrough and wherein each of the holes in one flange is horizontally aligned with a corresponding hole in the other flange, a blade bracket having a hollow annular portion attached to the end of the bracket adjacent to the blade mount, one or more resilient bushings disposed within the annular portion, a first rod disposed through the center of the bushings and through horizontally corresponding holes in each of the blade mount vertical flanges, a generally flat scraper blade removably attached to the blade bracket, two angle adjustment arms, one end of each arm being pivotally attached to the end of the blade bracket furthest from the blade mount and the other end of each arm supported by a second rod disposed through horizontally corresponding holes in each of the blade mount vertical flanges, wherein the holes through which the second rod is disposed are vertically above the holes through which the first rod is disposed.

In a further aspect of the present invention, a mechanism for controlling the steering and the forward and reverse movement of a vehicle of the type having means for driving the left and right sides of the vehicle independently and a means for controlling the forward and reverse direction of each independent drive means is disclosed. This mechanism comprises a horizontally disposed crossbar rotatably connected at each end to a support mounted to the vehicle, wherein the longitudinal axis of rotation of the crossbar is perpendicular to the forward and reverse directions of the vehicle, a generally T-shaped yoke having a cross portion attached at its center to a straight portion. The end of the straight portion not attached to the cross portion is rotatably attached to the crossbar. The longitudinal axis of rotation of the straight portion is generally perpendicular to the longitudinal axis of rotation of the crossbar. The mechanism further comprises two connecting linkages, one of which is connected at one of its ends to the end of the cross portion on the left side of the vehicle and is connected at the other of its ends to the means for controlling the forward and reverse direction of the means for driving the left side of the vehicle, and the other of which is connected at one of its ends to the end of the cross portion on the right side of the vehicle and is connected at the other of its ends to the means for controlling the forward and reverse direction of the means for driving the right side of the vehicle.

BRIEF DESCRIPTION OF THE DRAWINGS

FIGS. 3A and 3B are detailed cross-sectional views of the scraper blade and blade bracket showing the bushing and blade at rest and during use.

FIGS. 4A and 4B are partial detailed cross-sectional views of the scraper blade and blade bracket showing the self-sharpening of the blade resulting from use.

DETAILED DESCRIPTION OF THE PREFERRED EMBODIMENTS

Figure 1:
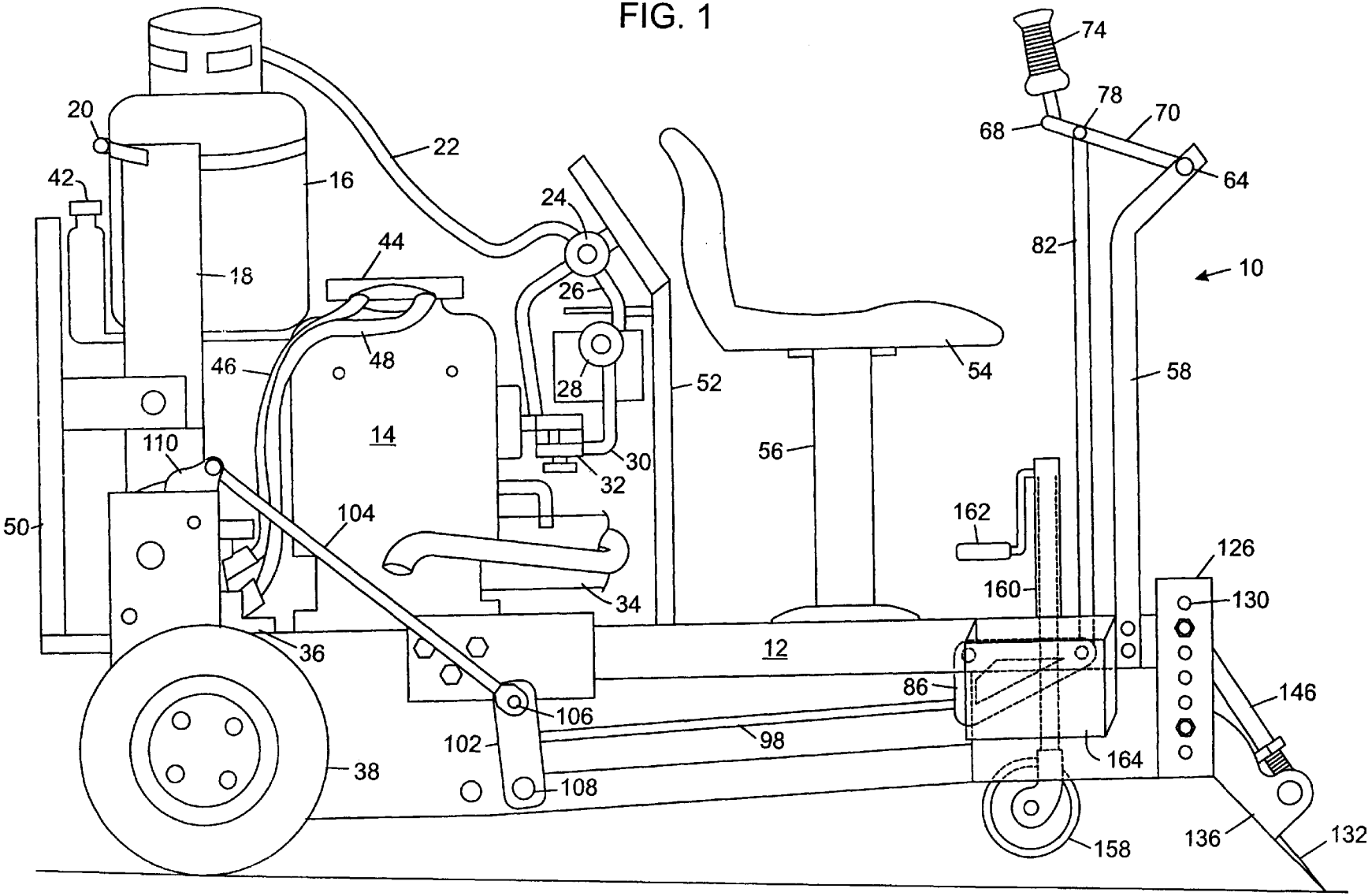
FIG. 1 is a side elevational view of a floor covering scraper machine in accordance with the present invention.
Figure 7:
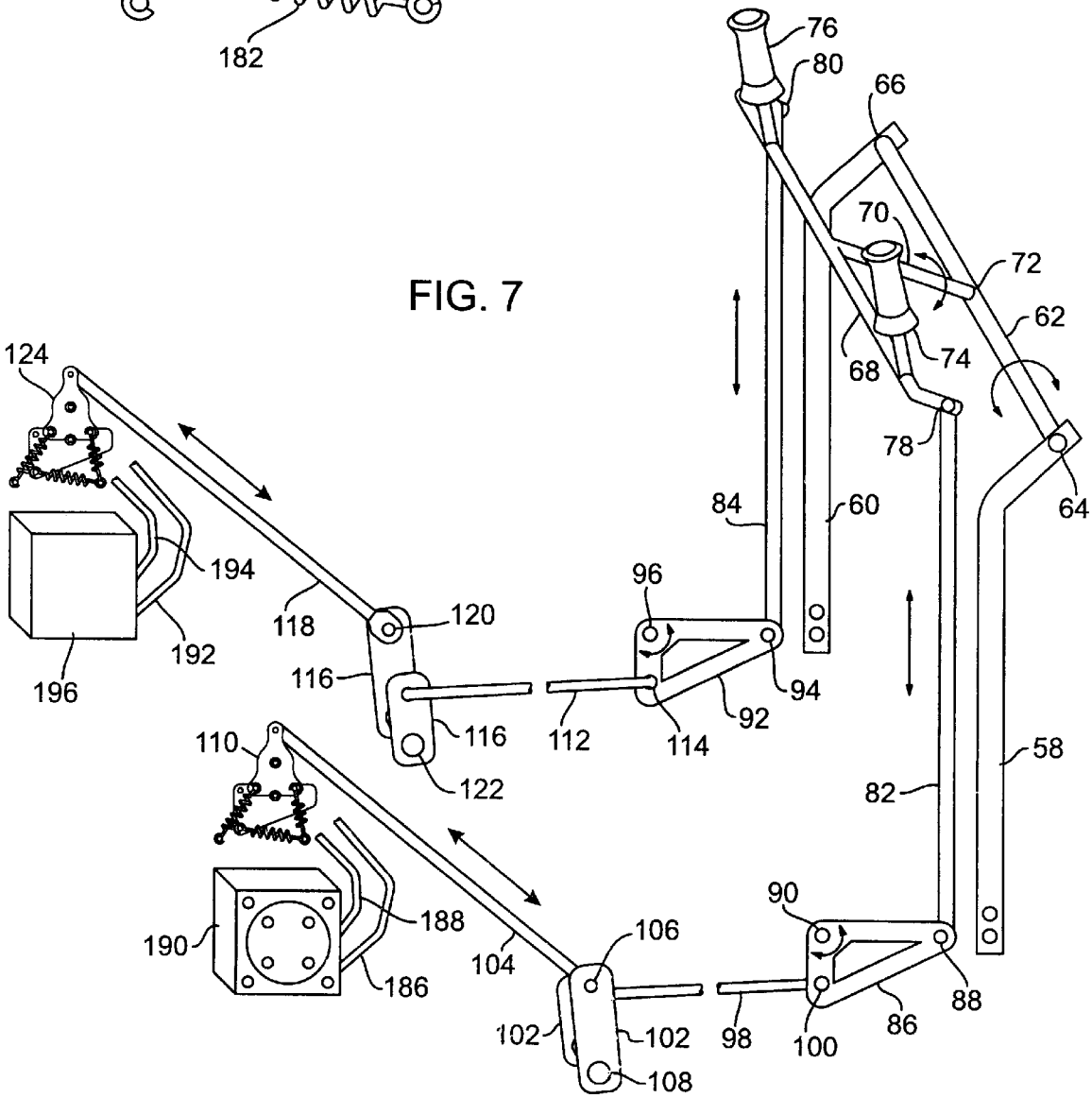
FIG. 7 is a perspective view of the control mechanism of the present invention.

Referring now to the drawings, wherein like reference numerals refer to like elements, a first embodiment of a self-propelled floor covering scraper machine of the present invention intended for commercial use, is shown in FIG. 1 and designated generally by the numeral 10. Scraper machine 10 is supported on main frame 12. An internal combustion engine 14 is mounted onto the rear section of main frame 12. Fuel for engine 14 is contained in propane tank 16 which is secured to support 18 by bracket 20. Tank 16 is connected by fuel line 22 to vacuum safety shut off 24 which in turn is connected by line 26 to fuel controller (regulator and zero governor) 28. Fuel controller 28 is connected by line 30 to propane carburetor 32. Muffler 34 is connected to the exhaust of internal combustion engine 14. Two hydraulic pumps are located behind engine 14, one on each side of frame 12 adjacent to each wheel. As shown in FIG. 7, hydraulic pump 36 on the right rear side of machine 10 is connected by two hydraulic pump lines 186 and 188 to hydraulic 190 motor connected to each wheel 38. An identical hydraulic pump on the left rear side of machine 20 is connected by two hydraulic lines 192 and 194 to hydraulic motor 196 which is connected to the left rear wheel (not shown). The tires are preferably filled with foam to prevent punctures. The size of the tires is selected to provide the machine with limited traction so that when irregularities in the floor are encountered with the blade, the wheels will slip and lessen the chance of damage to the machine and injury to the operator. Hydraulic oil is contained in hydraulic oil reservoir 42. Hydraulic oil cooler 44 is connected by hydraulic oil cooler lines 46 and 48 to hydraulic pump 36. Rear guard 50 is mounted on main frame 12 behind engine 14 and attached to support 18. Heat shield 52 is mounted on main frame 12 in front of engine 14. The operator's seat 54 is attached to seat mount 56 which in turn is attached to main frame 12 in front of heat shield 52.

Figure 9:
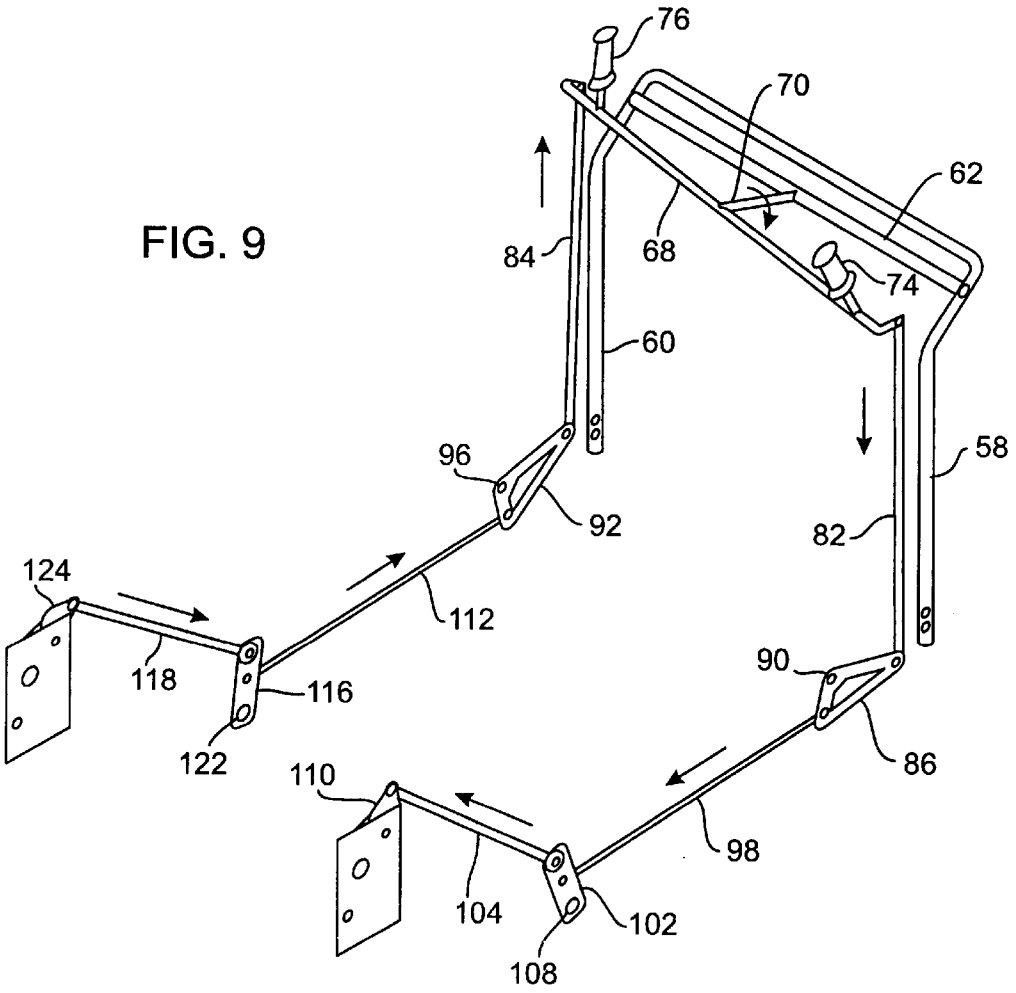
FIG. 9 is a perspective view showing the operation of the control mechanism in accordance with the present invention.

Referring to FIGS. 1 and 7, control support bars 58 and 60 are mounted to the front end of main frame 12. Crossbar 62 is rotatably connected to support bars 58 and 60 at points 64 and 66, respectively, in a manner which permits crossbar 62 to rotate about its longitudinal axis. The control mechanism is a generally T-shaped yoke having a cross portion 68 attached in its center to a straight portion 70. The end of straight portion 70, which is not attached to cross portion 68 is connected to crossbar 62 in a manner which permits straight portion 70 to rotate about its longitudinal axis. Two control hand grips 74 and 76 are attached to cross portion 68 of the control mechanism. The two ends of cross portion 68 are connected at points 78 and 80 to linkage rods 82 and 84, respectively. Linkage rod 82 is pivotally connected to front linkage 86 at point 88. Linkage 86 pivots about point 90 which is attached to main frame 12. Similarly, linkage rod 84 is pivotally connected to front linkage 92 at point 94. Linkage 92 pivots about point 96 which is attached to main frame 12. Front linkage 86 is also pivotally connected to linkage rod 98 at point 100. The other end of rod 98 is pivotally connected to rear linkage 102 which can be a single piece, such as is shown in FIG. 9, or more than one piece rigidly connected to function as a single linkage, as is shown in FIG. 7. Linkage 102 is also pivotally connected to linkage rod 104 at point 106. Linkage 102 pivots about point 108 which is attached to main frame 12. Rod 104 is pivotally connected to hydraulic pump control 110. Similarly, front linkage 92 is pivotally connected to linkage rod 112 at point 114. The other end of rod 112 is pivotally connected to rear linkage 116 which is similar in structure to rear linkage 102. Linkage 116 is also pivotally connected to linkage rod 118 at point 120. Linkage 116 pivots about point 122 which is attached to main frame 12. Rod 118 is pivotally connected to hydraulic pump control 124.

Referring now to FIGS. 1, 3A, 3B, 5A and 5B, a front blade mount comprising vertical flanges 126 and 128 is mounted to the front end of main fame 12. Flanges 126 and 128 each have a plurality of holes 130 arranged vertically. Scraper blade 132 is mounted onto a blade bracket comprising a flat portion 134 and two side flanges 136 and 138 generally perpendicular to the flat portion. Blade 132 is preferably about 8 inches wide along the edge which contacts the floor and is made of a material such as hardened steel having a thickness of about ⅛–3/16 inch thick so that it can flex while scraping. The blade bracket also comprises a hollow pipe 140 attached at each end to the upper ends of flanges 136 and 138. A bushing 142, made of compressed rubber or other suitable resilient material, is disposed within pipe 140 at each of its ends. The blade,bracket is rotatably attached to the front blade mount by means of a rod 144 which extends through the center of bushing 142 and through holes 130, in flanges 126 and 128. The two ends of rod 144 may be threaded and secured by nuts on the outside of flanges 126 and 128. Scraper blade 132 is maintained at the proper angle relative to the floor by means of two angle adjustment arms 146 and 148. Arm 146 is rotatably attached to the lower end of flange 136 at point 150, and arm 148 is likewise rotatably attached to the lower end of flange 138 at point 152. The upper ends of arms 146 and 148 are attached to hollow pipe 154 at each of its ends. Arms 146 and 148 are rotatably attached to the front blade mount by means of a rod 156 which extends through the center of pipe 154 and through holes 130 in flanges 126 and 128. The two ends of rod 156 may be threaded and secured by nuts on the outside of flanges 126 and 128. The lower ends of arms 146 and 148 are threaded to permit small adjustments to the angle of the blade.

Figure 2:
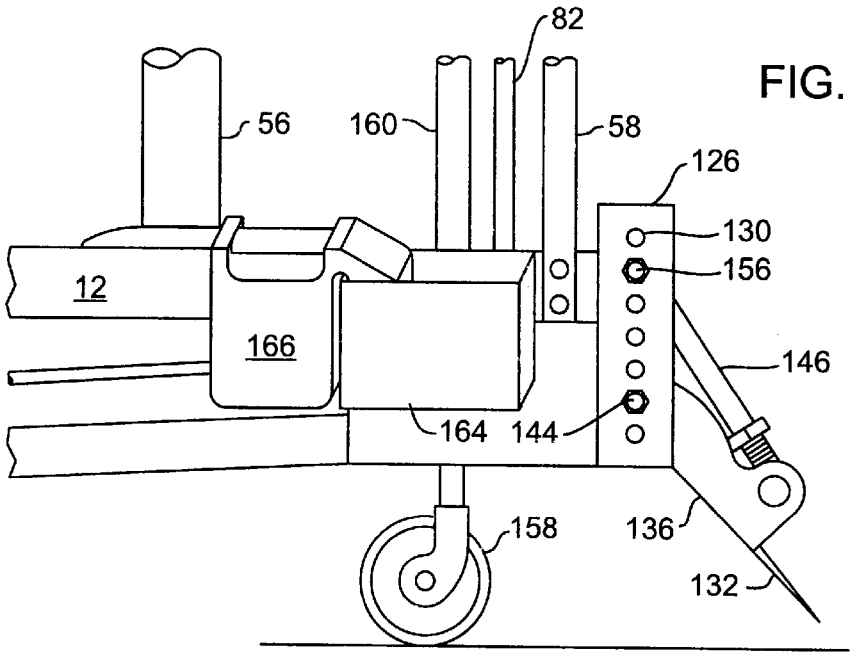
FIG. 2 is a partial side elevational view of the front end of the scraper machine in accordance with the present invention.

Referring to FIGS. 1 and 2, a retractable front wheel 158 is mounted to the front end of main frame 12 by means of support 160. Wheel 158 and support 160 can be raised and lowered by means of crank 162. In FIG. 1 wheel 158 is shown in its raised position, not touching the floor, and blade 132 is shown touching the floor. In order to raise blade 132 off of the floor, wheel 158 is lowered until it touches the floor. By continuing to lower wheel 158 after it has touched the floor, blade 132 will be raised off the floor, as shown in FIG. 2. A quick change weight bracket 164 is attached on each side of main frame 12. If additional weight is required in order to put more force on blade 132, weights 166 can be hooked onto or inserted into brackets 164.

Referring now to FIGS. 4A and 4B, when blade 132 is first mounted onto the blade bracket, the edge of blade 132 which touches the floor is sharpened on its top surface as shown in FIG. 4A. After an extended period of use removing tiles from floors, the bottom edge of blade 132 becomes worn by contact with the floor so that the edge is flush with the surface of the floor. In this way, the blade becomes self-sharpening, as shown in FIG. 4B.

In order to operate scraper machine 10, the valve on propane tank 16 is opened, the throttle is adjusted, the vacuum safety shut off 24 is by-passed for 1–2 seconds, and the internal combustion engine 14 is primed by holding in the purge button 1–2 seconds on the fuel controller 28. The ignition is then turned on while holding in on vacuum s button on vacuum safety shut off 24 until engine 14 starts, at which point the button is released. The engine speed is then set to the desired RPM. If machine 10 is located on the floor from which tile or other floor covering is to be removed, then wheel 158 is raised off of the floor by crank 162 until the weight of machine 10 rests on blade 132 on the floor. If the machine is not on the floor covering to be scraped, then the machine is first driven to that location with wheel 158 touching the floor and blade 132 raised off the floor as shown in FIG. 2. Once the location to be scraped is reached, then wheel 158 is raised and blade 132 is lowered.

Figure 6:
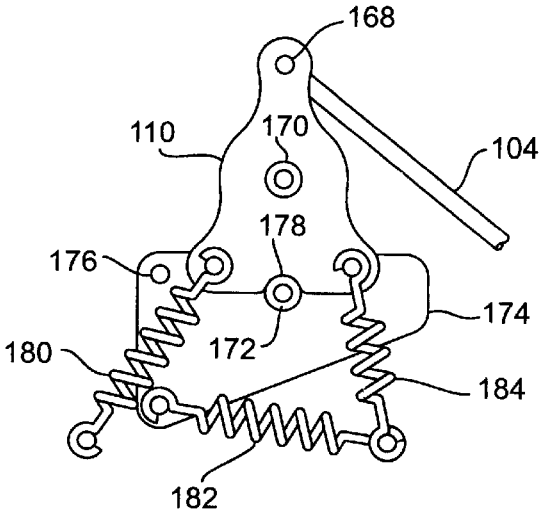
FIG. 6 is an enlarged side elevational view of the neutral return mechanism connected to the control mechanism of the present invention.
Figure 8A:
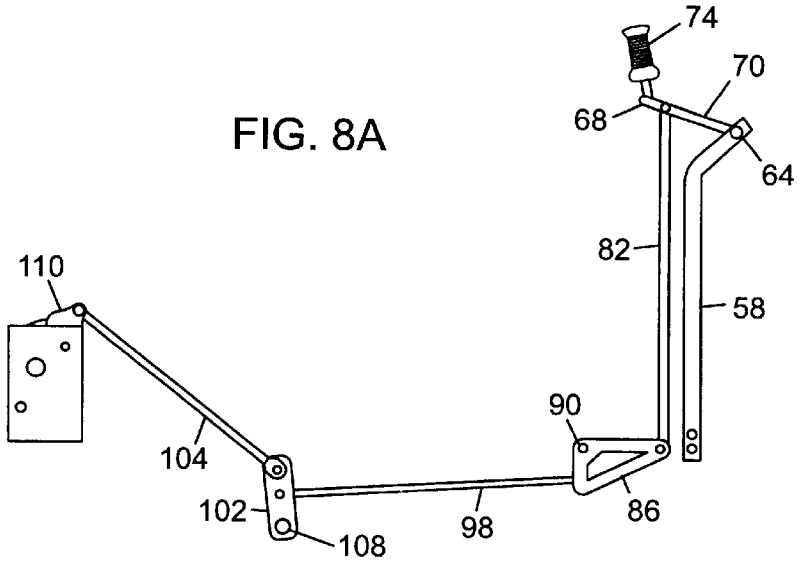
FIGS. 8A, 8B and 8C are side elevational views showing the operation of the control mechanism of the present invention.
Figure 8B:
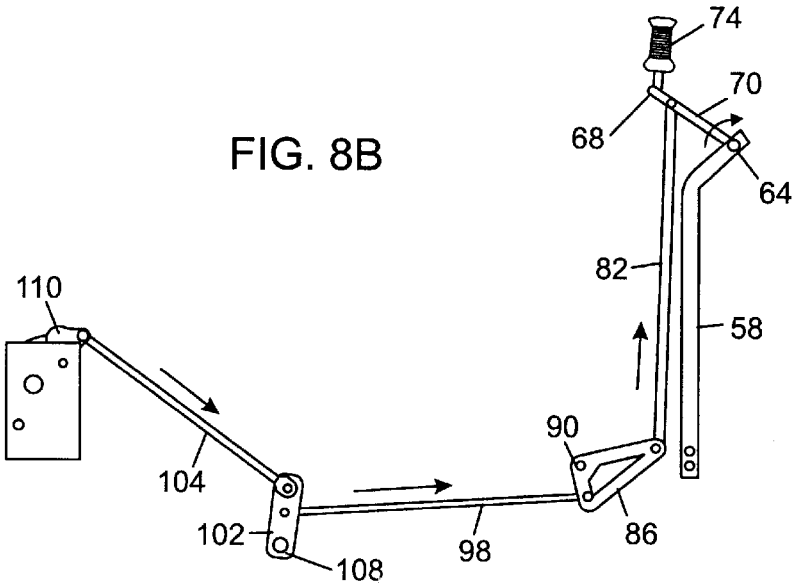
Figure 8C:
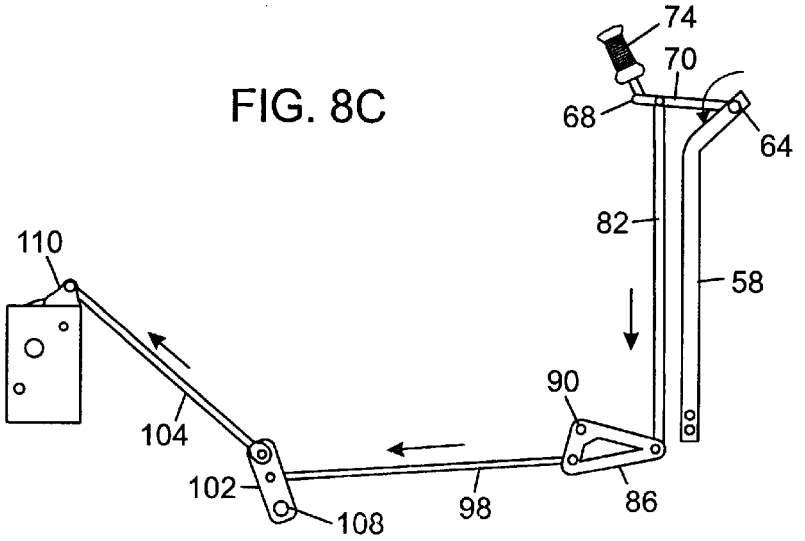

With the weight of machine 10 resting on blade 132 on top of the floor covering, scraping and removal of the floor covering can begin. The steering control mechanism is shown in the neutral position in FIGS. 7 and 8A. In this neutral position, one end of cross portion 68 is connected via linkage rod 82, front linkage 86, linkage rod 98, rear linkage 102 and linkage rod 104 to hydraulic pump control 110. As shown in FIG. 6, hydraulic pump control 110 pivots about point 170 over roller 172 which is attached to neutral locator 174. Neutral locator 174 pivots about point 176. As linkage rod 104 moves forward or backward, the edge of hydraulic pump control 110 is caused to roll away from roller 172. If the operator releases the control mechanism, return springs 180, 182 and 184 cause control 110 to return to the neutral position in which recession 178 engages roller 172. In order to move machine 10 forward, the operator sitting in seat 54 grasps the two hand grips 74 and 76 attached to the control mechanism with both hands and pushes the two hand grips forward an equal amount. As hand grips 74 and 76 are pushed forward, cross portion 68 and straight portion 70 of the generally T-shaped mechanism are moved upward and forward as they rotate about the longitudinal axis of crossbar 62 to which portion 70 is rotatably connected at point 72. Referring to FIG. 8B, as cross portion 68 moves upward and forward, the end of cross portion 68 attached to linkage rod 82 at point 78 moves upward and forward thereby pulling rod 82 generally upward. The upward movement of linkage rod 82 which is attached to front linkage 86 at point 88 causes linkage 86 to pivot about stationary point 90. The rotation of linkage 86 about point 90 pulls linkage rod 98 attached to linkage 86 at point 100 in a generally forward direction. The forward motion of linkage rod 98 attached to rear linkage 102 causes linkage 102 to pivot forward about point 108. The forward motion of linkage 102 attached to linkage rod 104 at point 106 pulls linkage rod 104 in a generally forward direction. The forward motion of linkage rod 104 which is attached to hydraulic pump control 110 at point 168 pulls control 110 forward. When control 110 is moved in a forward direction, hydraulic oil is pumped from hydraulic pump 36 through hydraulic line 186 into hydraulic motor 190 thereby causing wheel 38 to rotate in a forward direction. Similarly, the upward and forward movement of cross portion 68 of the control mechanism pulls linkage rod 84 generally upward thereby causing front linkage 92 to pivot about point 96. The rotation of linkage 92 about point 96 pulls linkage rod 112 in a generally forward direction, which causes linkage 116 to pivot about point 122. The forward motion of linkage 116 pulls linkage rod 118 in a generally forward direction which in turn pulls hydraulic pump control 124 forward. When control 124 is moved in a forward direction, hydraulic oil is pumped from an hydraulic pump identical to pump 36, but located on the left rear side of machine 10, through hydraulic line 192 into hydraulic motor 196 thereby causing the left rear wheel to rotate in a forward direction. Thus, pulling hand grip 74 back results in linkage rod 110 pushing hydraulic pump control 110 backward. When control 110 is moved in a backward direction, hydraulic oil is pumped through hydraulic pump 36 through hydraulic line 188 into hydraulic motor 190 thereby causing wheel 38 to rotate in a rearward direction. Similarly, the backward and downward movement of cross portion 68 of the control mechanism pushes linkage rod 84 generally downward, resulting in the connected linkages and rods pushing hydraulic pump control 124 backward. When control 124 is moved in a backward direction, hydraulic oil is pumped from an hydraulic pump identical to pump 36, but located on the left rear side of machine 10, through hydraulic line 194 into hydraulic motor 196 thereby causing the left rear wheel to rotate in a rearward direction. Thus, when the operator pulls back equally with both hands on hand grips 74 and 76, an equal amount of movement will be transmitted through the linkages on both the left and right sides to the two hydraulic pumps, which in turn will cause the two hydraulic motors attached to the two wheels to rotate the wheels an equal amount on both sides, thereby moving machine 10 rearward in a straight line.

Since the two hydraulic motors attached to the two wheels are controlled independently of each other, it is possible to control the direction of each wheel independently of the other. Referring to FIGS. 7 and 9, if the operator would like machine 10 to turn to the right, right hand grip 74 can be maintained in its neutral position while left hand grip 76 is being pushed upward, forward and to the right. This is possible because the control mechanism has the ability to rotate around two independent axes of rotation. As described above, by pushing upward and forward on hand grip 76, cross portion 68 and straight portion 70 of the generally T-shaped control mechanism are moved upward and forward as they rotate about the longitudinal axis of crossbar 62 to which straight portion 70 is rotatably connected at point 72. This longitudinal axis of rotation of crossbar 62 passes through points 64 and 66 in support bars 58 and 60, respectively. By pushing hand grip 76 upward and to the right, cross portion 68 will rotate about the longitudinal axis of straight portion 70 which passes through point 72. In this way, the operator will cause the left wheel to rotate in a forward direction while the right wheel remains in neutral thereby causing machine 10 to turn to the right. As shown in FIG. 9, it is also possible for the operator to push hand grip 76 upward, forward and to the right while at the same time pulling hand grip 74 backward, downward and to the left. This will cause the left wheel to rotate in a forward direction and the right wheel to rotate in a rearward direction, thereby causing machine 10 to spin around to the right. It is further possible while the machine is moving in a forward direction, for example, to push one of the hand grips more than the other in order to turn the machine. All of the possible ways to maneuver the machine described above with respect to moving forward or turning to the right can obviously be used to move the machine backward or turn it to the left simply by reversing the hand movements described above.

The single mechanism for controlling both steering and the forward and reverse movement of the machine in accordance with the present invention has been found to be particularly advantageous because of the ease with which an operator can learn to operate the machine. In conventional vehicles, such as a Bobcat, in which the wheels or tracks on the left and right sides of the vehicle are independently operated by control sticks on each side of the operator, many hours of practice are required before the operator is able to coordinate the movements of his arms and hands independently. Until the movements of both hands can be coordinated, the movements of the vehicle are not likely to be smooth or precise. In contrast, the control mechanism of the present invention is much easier to learn because the independent operation of the two motors connected to the wheels is linked by the control mechanism which physically limits the extent to which the movement on one side of the machine can be different from the movement on the other side of the machine. In addition, because the control mechanism is free to rotate independently about two axes, the direction and rotation of the wheels are controlled not only by a generally forward and backward hand motion, but also by a generally left and right turning motion similar to that with a conventional steering wheel. As a result, it has been found that an unskilled operator can quickly learn to operate the control mechanism of the present invention.

Figure 5A:
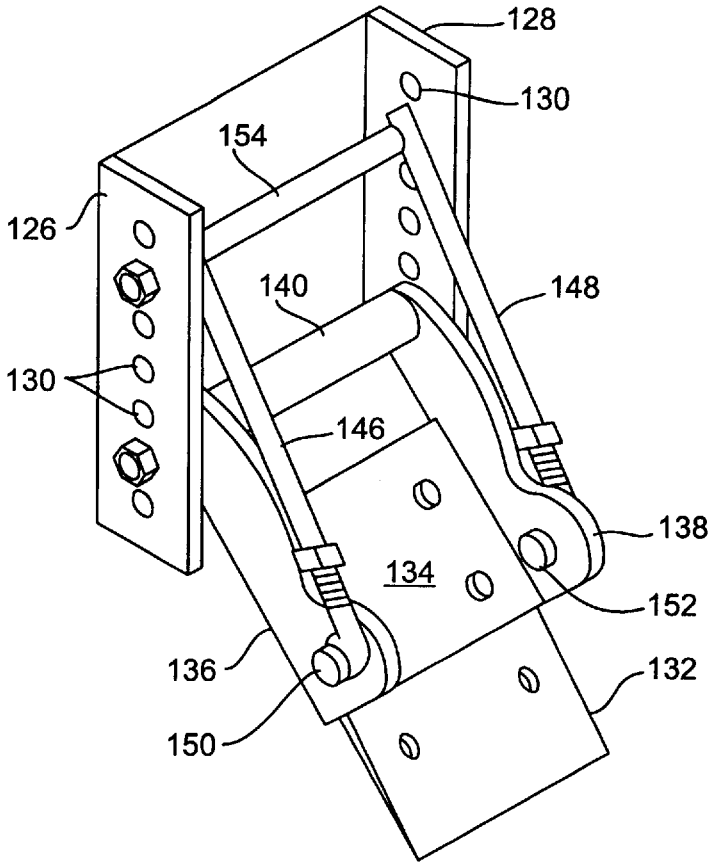
FIGS. 5A and 5B are perspective views showing the operation of the scraper blade used on the scraper machine of the present invention.
Figure 5B:
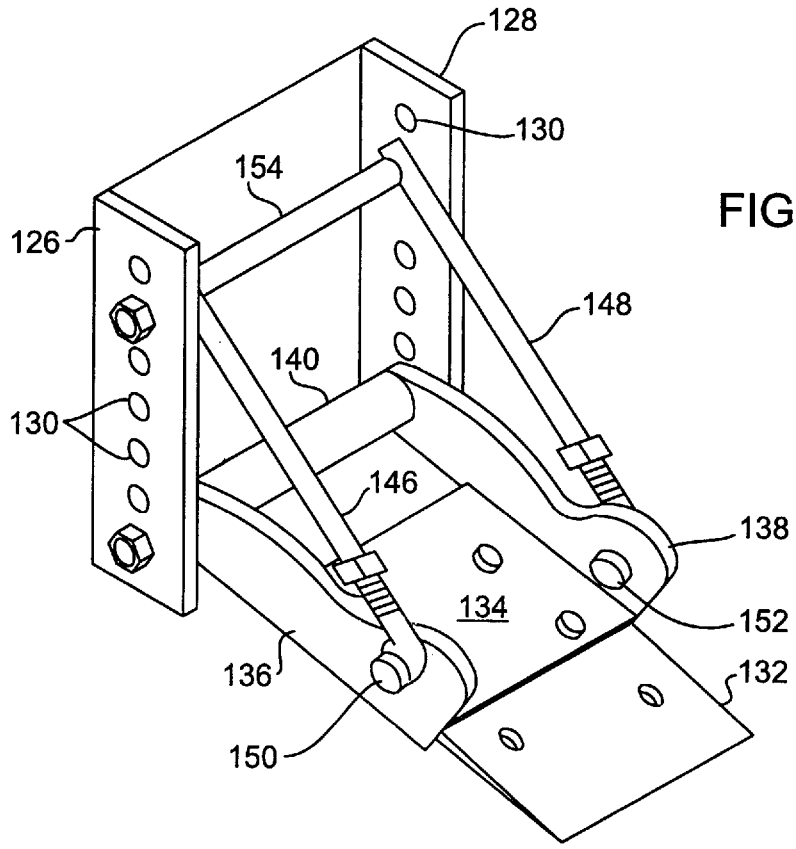

After the operator has become familiar with the use of the single control mechanism to control both the steering as well as the forward and reverse movement of the vehicle, the operator can then use the machine to remove tile or other floor covering from the floor. It is at this time that the optimum blade angle and weight on the front end of the machine should be determined. The proper blade angle and weight will depend upon such factors as type of tile or floor covering, type of adhesive used, age of tile or floor covering, and the environment in which it was used. The blade 132 and blade bracket may be initially mounted in the front blade mount, for example as shown in FIG. 5A, wherein the rod 156 through pipe 154 is inserted through the second hole from the top in each of flanges 126 and 128 and rod 144 through bushing 142 within pipe 140 is inserted through the second hole from the bottom in each of flanges 126 and 128. This arrangement provides the rather steep blade angle as shown from the side in FIG. 3A. If it is determined after operating the machine for awhile that this steep angle does not permit the blade to scrape under the tile and remove if from the floor, then the operator may adjust the blade angle as shown in FIG. 5B, wherein rod 156 remains in the second hole from the top in each of flanges 126 and 128, but rod 144 is instead inserted through the bottom holes in each of flanges 126 and 128. This arrangement provides a less steep angle for blade 132. Alternatively, the operator might find that the blade angle as shown in FIG. 5B is not steep enough and that the blade rides over the top of the tile or floor covering rather than scraping it up. In that case, the operator might adjust the blade angle as shown in FIG. 5A. It is also possible that the blade angle is suitable, but that the machine simply does not have sufficient weight on the edge of the blade. In that case, the operator can add weight 166 onto quick change weight brackets 164 located on both the left and right sides of main frame 12.

Another advantageous feature of the blade assembly of the present invention is shown in FIGS. 3A and 3B. FIG. 3A shows the blade 132 and blade bracket when the machine is at rest. While at rest, the lower edge of blade 132 rests flat on the floor. As described above with respect to FIGS. 4A and 4B, after a period of use, the lower edge of blade 132 is worn so that it is flush with the floor. Also while at rest, bushings 142 are in their original shape. As machine 10 moves forward, the lower edge of blade 132 digs into the tiles 200 and the floor as shown in FIG. 3B, causing the blade bracket to be pushed backward and upward causing pipe 140 to compress one side of bushings 142 and causing the portion of blade 132 not supported by the blade bracket to flex. This compression of the bushings and flexing of the blade causes the lower edge of the blade to attack the floor and tiles like a chisel as shown in FIG. 3B. This has been found to be particularly effective in removing tiles and other floor coverings. Moreover, the bushings and blade flex absorb some of the shock to the blade and machine which otherwise might cause the welds to crack.

Thus, it can be seen that the self-propelled floor covering scraper machine of the present invention exhibits a number of advantages over prior art designs. The present machine is compact and easily maneuverable in small spaces. It is readily portable to and from job sites. Because it is self-propelled, it is not dependent upon connection to hydraulic hoses or electrical cords to remote power sources. The present machine has been designed to use weight and momentum to remove tile and other floor coverings by supporting the full weight of the machine, including additional weights if desired, as well as the weight of the operator on two wheels at the back end of the machine and on the edge of a scraper blade mounted on the front end of the machine. By combining the machine's speed and maneuverability together with the weight strategically placed on the edge of the scraper blade, tile and other floor coverings are quickly and easily removed.

What is claimed is:

1. A self-propelled floor covering scraper machine comprising:

(a) a frame having a front end and a back end;

(b) two independently controllable wheels, one of which is mounted toward the back end of the right side of the frame and the other of which is mounted toward the back end of the left side of the frame opposite the first wheel;

(c) a self-contained power source carried by said frame for independently driving each wheel in either a forward or reverse direction;

(d) an operator seat carried by said frame;

(e) a control mechanism accessible to an operator seated in said operator seat for steering the machine, engaging the driving means, and controlling the forward and reverse movement of each wheel; and (f) a scraper blade mounted to the front end of the frame at an angle extending downward and forward from the front end of the frame, said scraper blade being mounted to said front end of said frame by means of a scraper blade assembly comprising:

(1) a blade bracket attachable to the front of the machine;

(2) said scraper blade being generally flat and being attachable to the blade bracket;

(3) means for absorbing shock to the blade during use;

(4) a blade mount comprising two vertical flanges disposed perpendicular to the front of the machine, wherein each flange has a plurality of vertically aligned holes therethrough and wherein each of the holes in one flange is horizontally aligned with a corresponding hole in the other flange;

(5) said blade bracket having a hollow annular portion attached to the end of the bracket adjacent to the blade mount;

(6) one or more resilient bushings disposed within the annular portion, said one or more resilient bushings forming at least in part said blade shock absorbing means;

(7) a first rod disposed through the center of the bushings and through horizontally corresponding holes in each of the blade mount vertical flanges; and (8) two angle adjustment arms, one end of each arm being pivotally attached to the end of the blade bracket furthest from the blade mount and the other end of each arm supported by a second rod disposed through horizontally corresponding holes in each of the blade mount vertical flanges, wherein the holes through which the second rod is disposed are vertically above the holes through which the first rod is disposed.

2. The scraper machine of claim 1 wherein said self-contained power source comprises two hydraulic motors, one of which is connected to each wheel.

3. The scraper machine of claim 2 wherein said self-contained power source further comprises two hydraulic pumps, each of which is connected to one of said hydraulic motors, and an internal combustion engine for powering said hydraulic pumps.

4. A self-propelled floor covering scraper machine comprising:

(a) a frame having a front end and a back end;

(b) two independently controllable wheels, one of which is mounted toward the back end of the right side of the frame and the other of which is mounted toward the back end of the left side of the frame opposite the first wheel;

(c) means for independently driving each wheel in either a forward or reverse direction;

(d) a single control mechanism for steering the machine, engaging the driving means, and controlling the forward and reverse movement of each wheel, said single control mechanism comprising:

(1) a horizontally disposed crossbar rotatably connected at each end to a support mounted to the vehicle, wherein the longitudinal axis of rotation of the crossbar is perpendicular to the forward and reverse directions of the vehicle;

(1) a generally T-shaped yoke having a cross portion attached at its center to a straight portion, wherein the end of the straight portion not attached to the cross portion is rotatably attached to the crossbar, and wherein the longitudinal axis of rotation of the straight portion is generally perpendicular to the longitudinal axis of rotation of the crossbar; and (3) two connecting linkages, one of which is connected at one of its ends to the end of the cross portion on the left side of the vehicle and is connected at the other of its ends to the means for controlling the forward and reverse direction of the means for driving the left side of the vehicle, and the other of which is connected at one of its ends to the end of the cross portion on the right side of the vehicle and is connected at the other of its ends to the means for controlling the forward and reverse direction of the means for driving the right side of the vehicle; and (e) a scraper blade mounted to the front end of the frame at an angle extending downward and forward from the front end of the frame.

5. The scraper machine of claim 4 wherein the scraper blade is mounted to the front end of the frame by means of a scraper blade assembly, said assembly comprising:

(1) a blade bracket attachable to the front of the machine;

(b 2) said scraper blade being generally flat and being attachable to the blade bracket; and (3) means for absorbing shock to the blade during use.

6. The scraper machine of claim 5 wherein said scraper blade assembly further comprises:

(4) a blade mount comprising two vertical flanges disposed perpendicular to the front of the machine, wherein each flange has a plurality of vertically aligned holes therethrough and wherein each of the holes in one flange is horizontally aligned with a corresponding hole in the other flange;

(5) said blade bracket having a hollow annular portion attached to the end of the bracket adjacent to the blade mount;

(6) one or more resilient bushings disposed within the annular portion, said one or more resilient bushings forming at least in part said blade shock absorbing means;

(7) a first rod disposed through the center of the bushings and through horizontally corresponding holes in each of the blade mount vertical flanges; and (8) two angle adjustment arms, one end of each arm being pivotally attached to the end of the blade bracket furthest from the blade mount and the other end of each arm supported by a second rod disposed through horizontally corresponding holes in each of the blade mount vertical flanges, wherein the holes through which the second rod is disposed are vertically above the holes through which the first rod is disposed.

7. A floor covering scraper machine comprising:

(a) a frame having a front end and a back end;

(b) a pair of wheels mounted toward the back end of said frame on either side thereof;

(c) a drive source for driving said wheels;

(d) a scraper blade mounted to the front end of said frame at an angle extending downward and forward from the front end of the frame, said scraper blade supporting said front end of said frame during operation of said machine;

(e) an operator seat carried by said frame and located closer to the front end of said frame than to the back end of said frame in order to place a greater portion of the weight of an operator on said scraper blade than on said wheels when an operator is seated in said operator seat; and (f) a control mechanism accessible to an operator seated in said operator seat for steering the machine and engaging said drive source.

8. The scraper machine of claim 7 wherein said drive source comprises two independently controllable hydraulic motors, one of which is connected to each of said wheels.

9. The scraper machine of claim 8 wherein said drive source further comprises two hydraulic pumps, each of which is connected to one of said hydraulic motors.

10. The scraper machine of claim 9 wherein said drive source further comprises an internal combustion engine for powering said hydraulic pumps.

11. The scraper of claim 10 wherein said hydraulic motors, said hydraulic pumps and said internal combustion engine are mounted toward the back end of said frame.

12. A floor covering scraper machine comprising:

(a) a frame;

(b) first and second independently controllable traction means mounted on opposite sides of said frame for supporting and propelling said machine on a floor surface;

(c) a drive source carried by said frame for independently driving said respective first and second traction means in either a forward or reverse direction;

(d) a control mechanism for steering the machine, engaging said drive source and controlling the forward and reverse movement of each of said first and second traction means;

(e) a generally flat, stationary scraper blade mounted by means of a scraper blade assembly to the front end of the frame at an angle extending downward and forward from the front end of the frame, said scraper blade assembly comprising a blade bracket attachable to the front of said frame and means for absorbing shocks to the lower edge of the blade during use by allowing the angle of said blade to change relative to said frame, said scraper blade assembly further comprising:

(1) a blade mount comprising two vertical flanges disposed perpendicular to the front of the machine, wherein each flange has a plurality of vertically aligned holes therethrough and wherein each of the holes in one flange is horizontally aligned with a corresponding hole in the other flange;

(2) said blade bracket having a hollow annular portion attached to the end of the bracket adjacent to the blade mount;

(3) one or more resilient bushings disposed within the annular portion, said one or more resilient bushings forming at least in part said blade shock absorbing means;

(4) a first rod disposed through the center of the bushings and through horizontally corresponding holes in each of the blade mount vertical flanges; and (5) two angle adjustment arms, one end of each arm being pivotally attached to the end of the blade bracket furthest from the blade mount and the other end of each arm supported by a second rod disposed through horizontally corresponding holes in each of the blade mount vertical flanges, wherein the holes through which the second rod is disposed are vertically above the holes through which the first rod is disposed.

* * * * *